United States Patent [19]

Aulich et al.

[11] 3,976,020

[45] Aug. 24, 1976

[54] SEWING MACHINE AND IRONING DEVICE

[75] Inventors: Gunter Aulich; Dieter Schultz; Wilhelm Rösel, all of Wittenberge, Germany

[73] Assignee: VEB Nahaschinenwerk Wittenberge, Wittenberge, Germany

[22] Filed: May 9, 1975

[21] Appl. No.: 575,911

[30] Foreign Application Priority Data

May 20, 1974 Germany .....178601

[52] U.S. Cl. ..... 112/217; 38/7; 38/10; 38/15

[51] Int. Cl.[2] ..... D05B 27/00

[58] Field of Search ..... 112/136, 151, 217; 38/7, 8, 9, 10, 11, 15, 16, 17, 27

[56] References Cited

UNITED STATES PATENTS

| | | | |
|---|---|---|---|
| 247,486 | 9/1881 | Crawford | 38/7 |
| 1,477,547 | 12/1923 | Denemark | 112/217 X |
| 1,683,412 | 9/1928 | Rosenbaum et al. | 112/217 X |
| 1,702,271 | 2/1929 | Rosenbaum et al. | 112/217 X |
| 2,055,470 | 9/1936 | Anderson et al. | 112/217 |
| 2,159,416 | 5/1939 | Anderson | 112/217 |
| 3,659,537 | 5/1972 | Sigoda | 112/136 X |
| 3,742,822 | 7/1973 | Wren | 112/217 |

FOREIGN PATENTS OR APPLICATIONS

| | | | |
|---|---|---|---|
| 641,990 | 2/1937 | Germany | 38/7 |

*Primary Examiner*—Werner H. Schroeder
*Assistant Examiner*—Moshe I. Cohen
*Attorney, Agent, or Firm*—Nolte and Nolte

[57] ABSTRACT

There is disclosed a sewing machine and ironing device for sewing and ironing seams in which two ironing elements are disposed on opposite sides of the path followed by the seam as it issues from a region at which the sewing is completed, one of which is urged towards the other magnetically to apply ironing pressure to a seam disposed therebetween.

6 Claims, 3 Drawing Figures

SEWING MACHINE AND IRONING DEVICE

This invention is concerned with apparatus for sewing seams and for ironing those seams. Such apparatus usually comprises two ironing elements, one of which is fixed and the other of which is movable towards the fixed element to apply ironing pressure to a seam therebetween. These devices usually have means for heating one or both of the ironing elements, means for transporting the fabric between the elements and means for directing steam at the fabric to be ironed.

A known structure of this kind has had the movable ironing element mounted on a beam or linkage pivoted at a point remote from the region at which sewing occurs and on that side of the sewing region to which the fabric advances. A very pronounced disadvantage of that arrangement is that when sewing and ironing tubular pieces, such as sleeves or trouser legs, the pieces cannot be removed from the ironing element in the direction in which they pass through the ironing and sewing zones because of course the ironing element over which they pass is pivoted on that side of the ironing zone. Thus, it is necessary for an operator to swing the movable ironing element away from the fixed ironing element and remove the piece by drawing it backwardly from that element.

Additionally, because the movable ironing element is mounted upon a force transmitting linkage which is pivoted at a remote location from said ironing region, the linkage must be relatively large and this again poses problems with sewing small tubular items, as for example the sleeves or legs of children's garments for, of course, they cannot pass over the linkage and connections between the linkage and ironing element.

Another arrangement is known in which the movable ironing element is mounted upon a force transmitting linkage which extends from a point at a location ahead of the sewing region so that the fabric to be sewn is passed over and around the linkage before entry into the sewing region and thereafter the seam is completed to dispose the fabric around the ironing element. This, of course, allows for the tubular piece to be removed from the ironing element in the direction in which the piece advances through the sewing and ironing regions but again, because the ironing pressure is applied through the linkage from a position remote from that at which the ironing takes place, the linkage must be robust and consequently large and again the problem of handling small tubular items is present and, with that substantial linkage in front of the operator, the operator experiences considerable difficulty in accurately feeding the fabric into the sewing region.

In an attempt to avoid the disadvantages of these two structures discussed hereabove, it has been proposed to have the movable ironing element supported between belt drives and to have independently operable pressure rollers associated therewith so that the ironing pressure is applied over spring-loaded, inclined pressure rollers which act on the movable ironing element, however, the cost of such an arrangement and the complexity of it and the consequent difficulty in maintenance renders such a structure prohibitive, especially when one considers that such a device is an accessory to the sewing machine.

According to the present invention, this may be avoided by the provision of a movable ironing element which is magnetically urged towards a fixed ironing element to apply ironing pressure to fabric between those two elements. The movable ironing element can be guided by a relatively light-weight linkage, since of course the force for applying the pressure to the ironing element is not transmitted through that linkage. Most desirably, the linkage is pivoted on that side of the sewing region from which the fabric enters the sewing region so that the sewn and ironed piece may be removed from the apparatus in the same direction that it progresses through that apparatus.

In a preferred embodiment, the fixed ironing element can be constituted as a magnet and, of course, the movable ironing element will act as an armature, being attracted to that magnet. Desirably, the magnets would be electro-magnets, but permanent magnets could be utilized.

An embodiment of the present invention is illustrated in the accompanying drawings in which.

Figure 1:
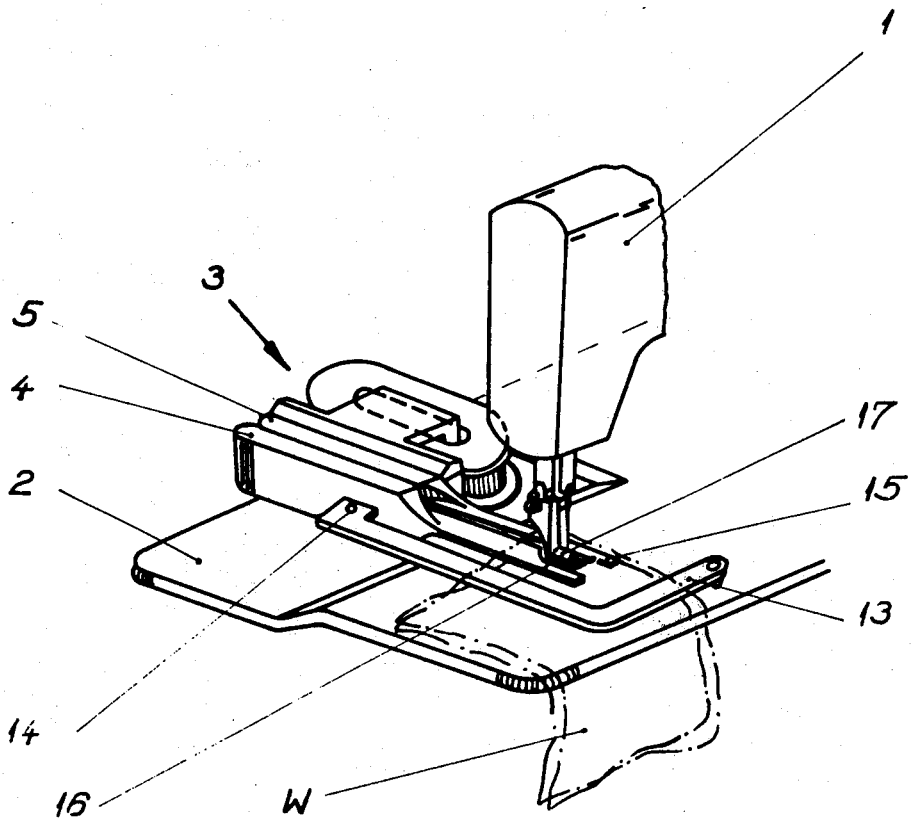
FIG. 1 is a perspective view illustrating the general arrangement of the apparatus according to this invention.

Referring to the FIG. 1 arrangement, there is illustrated a sewing machine 1 of largely conventional form secured on a table forming a working surface, indicated generally at 2, and immediately following the sewing machine, in the direction of progress of fabric through the machine is an ironing apparatus generally indicated at 3. The ironing apparatus comprises a movable ironing element 4 and a fixed ironing element 5.

Figure 2:
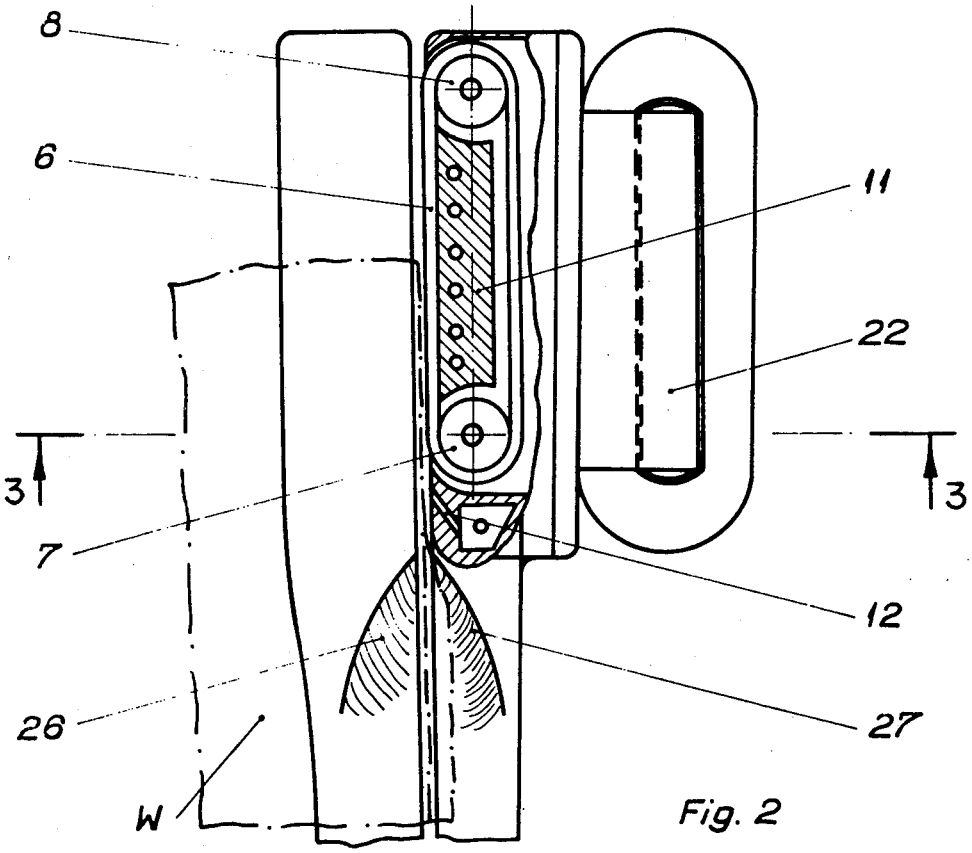
FIG. 2 is partly sectioned plan view of a detail of the apparatus of FIG. 1.
Figure 3:
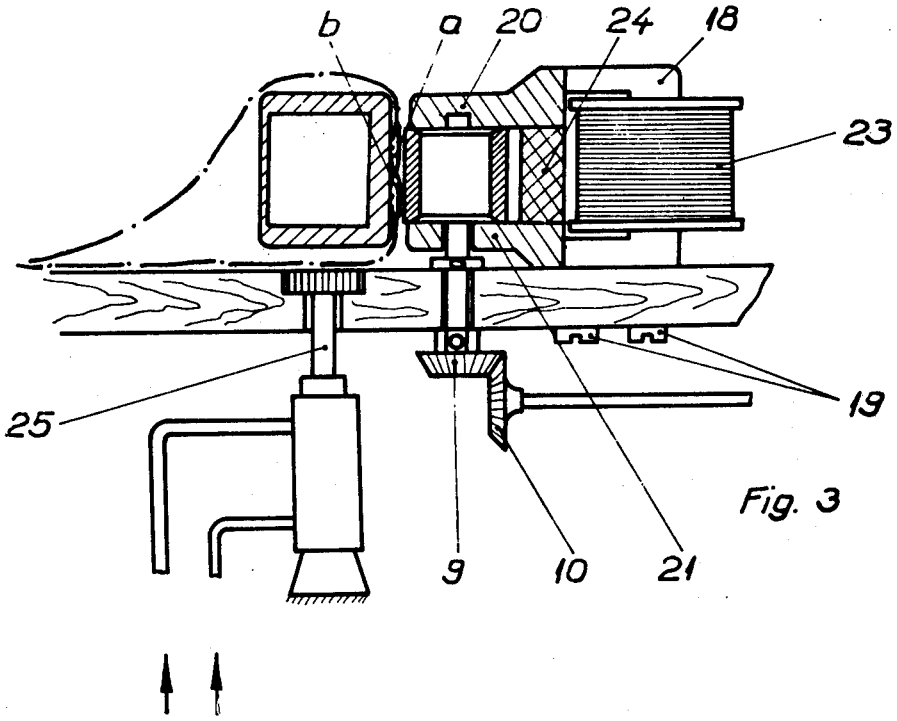
FIG. 3 is a section on the line 3—3 of FIG. 2.

Referring particularly to FIGS. 2 and 3, it will be seen that the fixed ironing element, which in effect is similar to an anvil cooperating with the movable ironing element, has a surface constituted by an endless belt 6 trained around rollers 7 and 8 of which at least one is driven through bevel gears 9 and 10 from the sewing machine motor which, since it is entirely conventional, is not illustrated herein. Disposed between opposite courses of the endless belt 6 is a heater 11 which, besides providing heat in the ironing region, also supports endless belt 6 against the pressure applied to it, in the manner described hereinafter, by the movable ironing element 4. The fixed ironing element also includes one or more steam nozzles 12 disposed to direct steam against the fabric to be ironed and supplied by any convenient and conventional steam supply system. It will be appreciated that the belt 6 is effective to continuously drive the fabric to be ironed through the ironing region as it is received from the sewing machine.

The movable ironing element 4 is mounted on a generally U-shaped link 13 which is pivoted as at 13' in front of presser foot 17, i.e. in front of the region in which sewing takes place and, as the operator views the sewing region, to the right of that region. The link 13 is pivoted as at 14 to the movable ironing element 4 so that ironing element 4 can be brought into flush, face-to-face abutment with the surface of ironing element 5 defined by endless belt 6.

It is to be noted that the ironing elements 4 and 5 have guide elements 16 and 15, respectively, extending towards the presser foot on either side thereof and those elements lead to curved surfaces 26 and 27 respectively which dispose the fabric at the seam in the correct position to be ironed prior to entry into the ironing region.

With special reference to FIGS. 2 and 3, it will be seen that the ironing element 5 is constituted by arms 20 and 21 of a generally U- or yoke-shaped magnetic core generally indicated at 18 and secured to surface 2 by bolts, the heads of which are visible at 19 in FIG. 3. A non-magnetizable spacer 24 is disposed between the limbs 20 and 21 of the core member. Mounted on the base or cross piece of the core 18 is a coil 23 which is energizable to produce a magnetic field pulling movable ironing element 4 towards the fixed ironing element 5 to apply ironing pressure to fabric therebetween.

It is, of course, to be appreciated that control means are desirably provided for association with coil 23 to vary the magnetic field and hence, of course, the ironing pressure.

To support the movable ironing element directly opposite to the fixed ironing element during those periods when it is not attracted to the fixed element by the magnetic field induced by coil 23, there is disposed beneath the table and extending therethrough a piston element 25 which, through commonplace valving, is adapted when the coil is de-energized, to project upwardly above the surface of the table and support the ironing element and to be retracted to the level of the table, or at least to a position spaced from the ironing element when the magnet is energized to allow the passing of fabric between the table surface and the ironing element.

In operation, the fabric to one side of the seam is passed beneath link 13 and the fabric to the other side of the seam is placed over that link and fed directly to the sewing region. As the seamed fabric progresses from the sewing region, the guides 16, 15 and surfaces 26 and 27 turn the seam into the correct ironing position and the fabric is then conveyed through the ironing zone with the application of heat pressure and steam to produce a neatly finished item.

What is claimed is:

1. Apparatus for sewing and ironing a seam comprising sewing means for forming a seam in fabric presented thereto, ironing means and means defining a path for fabric to be sewed and ironed, said ironing means comprising a first ironing element disposed on one side of said path, mens mounting said first ironing element for movement towards said path, a second ironing element on the opposite side of said path, said first element cooperating with said second element to iron material therebetween and electro-magnetic means effective to urge said first element towards said second element to apply ironing pressure to fabric therebetween, wherein said electro-magnetic means comprises a core and coil means mounted on said second ironing element and wherein said first ironing element is constituted as an armature cooperating with said core and coil means.

2. Apparatus as claimed in claim 1 wherein said means for mounting said first ironing element comprises a linkage extending from that side of a region at which sewing takes place from which fabric to be sewn is presented, said linkage extending past the sewing region and being connected to said first ironing element.

3. Apparatus as claimed in claim 2 wherein said linkage comprises a generally U-shaped link pivotally connected to said first ironing element and pivotally mounted to a frame member on that side of the sewing region from which fabric is presented to the sewing means.

4. Apparatus as claimed in claim 1 wherein means are provided for supporting said first ironing element in a position directly opposite to said second ironing element, said means being operative to support said first ironing element when said electromagnet is de-energized and being shiftable to an inoperative position when said electromagnet is energized.

5. Apparatus as claimed in claim 4 wherein said supporting means comprises a piston/cylinder element.

6. Apparatus as claimed in claim 1 wherein said core member is generally U-shaped, being defined by a pair of arms and a bight section, said second ironing element being disposed between free ends of said arms of said core member and a coil winding disposed about the bight of said U-shaped member.

* * * * *